US008590285B2

(12) United States Patent
Hohmann et al.

(10) Patent No.: US 8,590,285 B2
(45) Date of Patent: Nov. 26, 2013

(54) THREE-POINT FIXING ARRANGEMENT OF IGNITION ELECTRODES OF A BURNER

(75) Inventors: Christian Hohmann, Mülheim an der Ruhr (DE); Andre Kluge, Dülmen (DE); Roland Liebe, Monheim (DE); Elmar Pfeiffer, Heinsberg (DE)

(73) Assignee: Siemens Aktiengesellschaft, Munich (DE)

( * ) Notice: Subject to any disclaimer, the term of this patent is extended or adjusted under 35 U.S.C. 154(b) by 646 days.

(21) Appl. No.: 12/665,389

(22) PCT Filed: Jun. 30, 2008

(86) PCT No.: PCT/EP2008/058353

§ 371 (c)(1),
(2), (4) Date: Jul. 16, 2010

(87) PCT Pub. No.: WO2009/003973

PCT Pub. Date: Jan. 8, 2009

(65) Prior Publication Data

US 2010/0281848 A1 Nov. 11, 2010

(30) Foreign Application Priority Data

Jul. 3, 2007 (EP) ..... 07013006

(51) Int. Cl.
*F02C 7/266* (2006.01)

(52) U.S. Cl.
USPC ..... 60/39.827; 60/39.821; 60/796; 431/343; 248/68.1; 248/226.12

(58) Field of Classification Search
USPC ..... 60/39.821–828, 796, 798; 431/343; 248/65, 68.1, 73, 74.1, 74.2, 226.11, 248/226.12, 227.4
See application file for complete search history.

(56) References Cited

U.S. PATENT DOCUMENTS

| | | | | |
|---|---|---|---|---|
| 2,896,334 | A * | 7/1959 | Dunderman | 33/652 |
| 2,934,897 | A * | 5/1960 | Waugh et al. | 60/789 |
| 3,223,141 | A * | 12/1965 | Safford | 431/265 |
| 3,253,084 | A * | 5/1966 | Taylor | 174/138 G |
| 3,360,201 | A * | 12/1967 | Popyk | 239/400 |
| 4,136,259 | A | 1/1979 | Djeddah | |
| 4,616,797 | A * | 10/1986 | Cramer | 248/227.4 |
| 4,701,124 | A | 10/1987 | Maghon et al. | |
| 4,791,734 | A * | 12/1988 | Wojtkowiak | 33/652 |
| 4,799,641 | A * | 1/1989 | Koreski | 248/68.1 |
| 5,413,478 | A | 5/1995 | Lang | |
| 5,464,179 | A * | 11/1995 | Ruckwardt | 248/68.1 |
| 6,038,852 | A * | 3/2000 | Celi | 60/761 |
| 6,561,792 | B1 * | 5/2003 | Pfund | 431/264 |

FOREIGN PATENT DOCUMENTS

| | | | |
|---|---|---|---|
| CN | 2624063 | Y | 7/2004 |
| CN | 1624389 | A | 6/2005 |
| DE | 9211464 | U1 | 11/1992 |
| DE | 29520584 | U1 | 2/1996 |

(Continued)

*Primary Examiner* — Ehud Gartenberg
*Assistant Examiner* — Lorne Meade

(57) ABSTRACT

A burner having two ignition electrodes and a bracket is provided. The bracket is arranged on the outer surface of the burner and the ignition electrodes are held, at in each case three points of their periphery, in a fixed position using the bracket. A gas turbine with the burner is also provided.

12 Claims, 4 Drawing Sheets

(56) References Cited

FOREIGN PATENT DOCUMENTS

| | | | |
|---|---|---|---|
| EP | 0193838 | A2 | 9/1986 |
| EP | 0593816 | A1 | 4/1994 |
| EP | 1605206 | A1 | 12/2005 |
| GB | 1190924 | A | 5/1970 |
| SU | 11877 | A1 | 10/1928 |

* cited by examiner

THREE-POINT FIXING ARRANGEMENT OF IGNITION ELECTRODES OF A BURNER

CROSS REFERENCE TO RELATED APPLICATIONS

This application is the US National Stage of International Application No. PCT/EP2008/058353, filed Jun. 30, 2008 and claims the benefit thereof. The International Application claims the benefits of European Patent Office application No. 07013006.7 EP filed Jul. 3, 2007, both of the applications are incorporated by reference herein in their entirety.

FIELD OF INVENTION

The present invention relates to the fixing of ignition electrodes to a burner of a gas turbine.

BACKGROUND OF INVENTION

One of the important components of a gas turbine is the so-called combustion chamber in which fuel is burnt with the aid of an oxidizer. The oxidizer typically involves air. The hot gas produced during combustion in the combustion chamber is conveyed onwards to a turbine.

What is referred to as the burner is located on the side of combustion chamber facing away from the turbine. This is used for igniting the fuel or the fuel-air mixture and is equipped with ignition electrodes for this purpose. The fuel and the air are injected through openings of the burner into the combustion chamber. The ignition electrodes are arranged in the vicinity of these openings and ignite the gas flowing past there. To this end an ignition spark is generated by applying an ignition voltage between two ignition electrodes. This ignition spark is present during the entire ignition duration. To obtain an optimum ignition spark a specific gap must be maintained precisely between the tips of the ignition electrodes.

Previously the ignition electrodes were frequently fixed to the outside surface of the burner with the aid of a clamp. In such cases the ignition electrodes are clamped rigidly in the clamp with the aid of a screw arranged centrally between the ignition electrodes. Typically the support surfaces of the ignition electrodes rest on their full circumference on their clamp which can for example have a round cross section. In the area of the clamp the ignition electrodes are usually surround by a ceramic shroud. The ceramic shroud is used for electrical insulation of the ignition electrodes and thus reduces the heat-related expansion. Fluctuations in the surface quality of the ceramic and inaccuracies in the form and the position of the clamp can lead to the ignition electrodes not being able to be fixed correctly. The fixing is either too firm or too loose. In the event of the fixing being too film the thermal expansion of the ignition electrodes is prevented and in the event of the fixing being too loose undesired vibrations of the ignition electrodes occur.

Typically the ignition electrodes are not arranged centrally between a so-called diagonal mesh and a burner carrier, since the clamps used for fixing the ignition electrodes are frequently screwed to a cam which has a certain height because of the minimum screw depth. The distance from the diagonal mesh is thus small and the result can be a sparkover in this area if the gap at this point is smaller than at the so-called spark gap at which the ignition sparks are to be generated. The result of this is that the burner involved can no longer be ignited directly.

A further difficulty of the ignition electrode fixings used previously lies in their sensitivity to impacts during installation and dismantling and also during transport of the burner. The ignition electrode glued into a ceramic normally does not rest directly on the burner. This can thus quickly result in bending and breakage of the ignition electrodes which makes it necessary to replace the ignition electrodes.

SUMMARY OF INVENTION

The object of the present invention is to make available a burner with an advantageous bracket for fixing the ignition electrodes.

This object is achieved by a burner, especially a gas turbine burner, as claimed in the claims. The dependent claims contain further advantageous embodiments of the invention.

The inventive burner comprises two ignition electrodes and a bracket, with the bracket being arranged on the outer surface of the burner. The burner is characterized by the ignition electrodes each being held in a defined position by the bracket at three points on their circumference. With this three-point fixing which, because of the axial extent of the bracket, can especially involve a three-line fixing, a statically optimum fixing is guaranteed. In this case the three fixing points or the three fixing lines can optimally be distributed over the circumference of the ignition electrodes such that the angle between them amounts to 120°.

The ignition electrodes can be supported to allow them to move axially in the bracket, which can be realized for example by a sprung embodiment of the bracket. Such an axial movement of the ignition electrodes can be caused by a thermal extension of the ignition electrodes. The support allowing axial movement enables axial thermal stresses in the ignition electrodes to be avoided. At the same time the ignition electrodes can be securely radially fixed, so that possible problems resulting from the lack of trueness in the gap between the ignition electrodes can be avoided.

Furthermore each ignition electrode can have a ceramic shroud. The ceramic shroud serves to isolate the ignition electrodes electrically. By comparison with other brackets, the inventive bracket with a three-point fixing offers the advantage of easily being able to compensate for possible variations in the surface quality of the ceramic without adversely affecting the static fixing of the ignition electrodes.

In addition the ignition electrodes can each rest on a sprung support in the bracket. This can especially be realized by the bracket comprising at least one radially sprung clamp. The radial springing makes it possible to compensate for vibrations, which prolongs the service life of the ignition electrodes. In conjunction with a possible use of a radially-sprung support clamp, the inventive three-point fixing makes it possible to compensate for possible inaccuracies in dimensions when the clamp is manufactured.

In a preferred embodiment of the invention the bracket comprises a support clamp and a fixing clamp. In this case the inventive three-point fixing can be achieved by the support clamp and the fixing clamp being embodied and arranged relative to one another such that each ignition electrode is held in a defined position by the support clamp at one point on its periphery and by the fixing clamp at two further points on its periphery. In this case the fixing clamp continues to be embodied so that it allows a spring effect and in addition by its tensile force allows the axial movement necessary to compensate for the thermal expansion. The use of just one support clamp and one fixing clamp to hold two ignition electrodes has the advantage of allowing an optimum fixing of the ignition electrodes to be achieved with the aid of a small number of components. This arrangement makes it easy to install and to replace the ignition electrodes.

Basically the inventive bracket can be fastened to the outer surface of the burner in any manner. It is however advantageous for the bracket to be fastened by at least two fastening elements to the outer surface of the burner. These fastening elements can in particular involve releasable fastening elements, for example screws. The use of at least two fastening elements, especially screws, has the advantage of the fixing clamp not being twisted in relation to the support clamp during fastening. By contrast with the use of only one fastening element, especially of only one screw, the use of at least two fastening elements does not result in an unevenly distributed retaining force and a bending of the ignition electrodes. A bending of the ignition electrodes is undesirable since it can cause an enlargement of the ignition gap and result in the ignition electrodes breaking.

The inventive burner can in particular involve the burner of a gas turbine. In this case, the possibly flat embodiment of the inventive bracket can enable the gap between the ignition electrodes and the burner carrier to which they are fastened to be reduced by comparison with other known brackets. This simultaneously makes the gap to the diagonal mesh located in the vicinity of the burner larger and avoids any sparkover to the diagonal mesh. Basically an even gap between the ignition electrodes and the diagonal mesh and the burner carrier can be ensured by the inventive bracket. In addition the flat embodiment of the bracket made possible by the inventive bracket offers better protection of the ignition electrodes during installation and dismantling, since the spacing to the diagonal mesh is enlarged.

Shaker table investigations have shown that the inherent frequencies of the ignition electrodes deviate greatly from one another depending on their fixing type. The knowledge and reproducibility of the inherent frequencies is of significance for the layout of the components. The optimum layout of the components allows possible breaks in the ignition electrodes to be avoided and their service life to be extended in this way. It has emerged that unique and reproducible inherent frequencies only occur with a firm clamping of the ignition electrodes. The inventive bracket on the one hand allows a firm clamping which permits unique and reproducible inherent frequencies. On the other hand the inventive bracket simultaneously allows axial and radial expansions to be compensated for without the firmness of the clamping being adversely affected thereby.

Overall the inventive burner, especially the inventive bracket, has numerous advantages. It makes possible a defined fixing of the ignition electrodes via three support points or support lines which in the ideal case are each distributed offset by 120° to each other around the periphery of ignition electrodes. The spring effect obtained with the aid of clamps makes it possible at accept any vibrations and expansions that occur. Critical stressing of the ignition electrodes and possible breaks thereof are avoided in this way. Simultaneously the clamps and the ignition electrodes can be rigidly fixed. Furthermore the number of components needed is very small. In addition a very flat embodiment of the bracket is possible.

BRIEF DESCRIPTION OF THE DRAWINGS

The inventive burner prevents ignition malfunctions in the diagonal mesh. In addition it reduces the danger of damaging the ignition electrodes when they are being installed or removed.

Further features, characteristics and advantages emerge from the description given below of exemplary embodiments which refer to the enclosed figures.

DETAILED DESCRIPTION OF INVENTION

Figure 1:
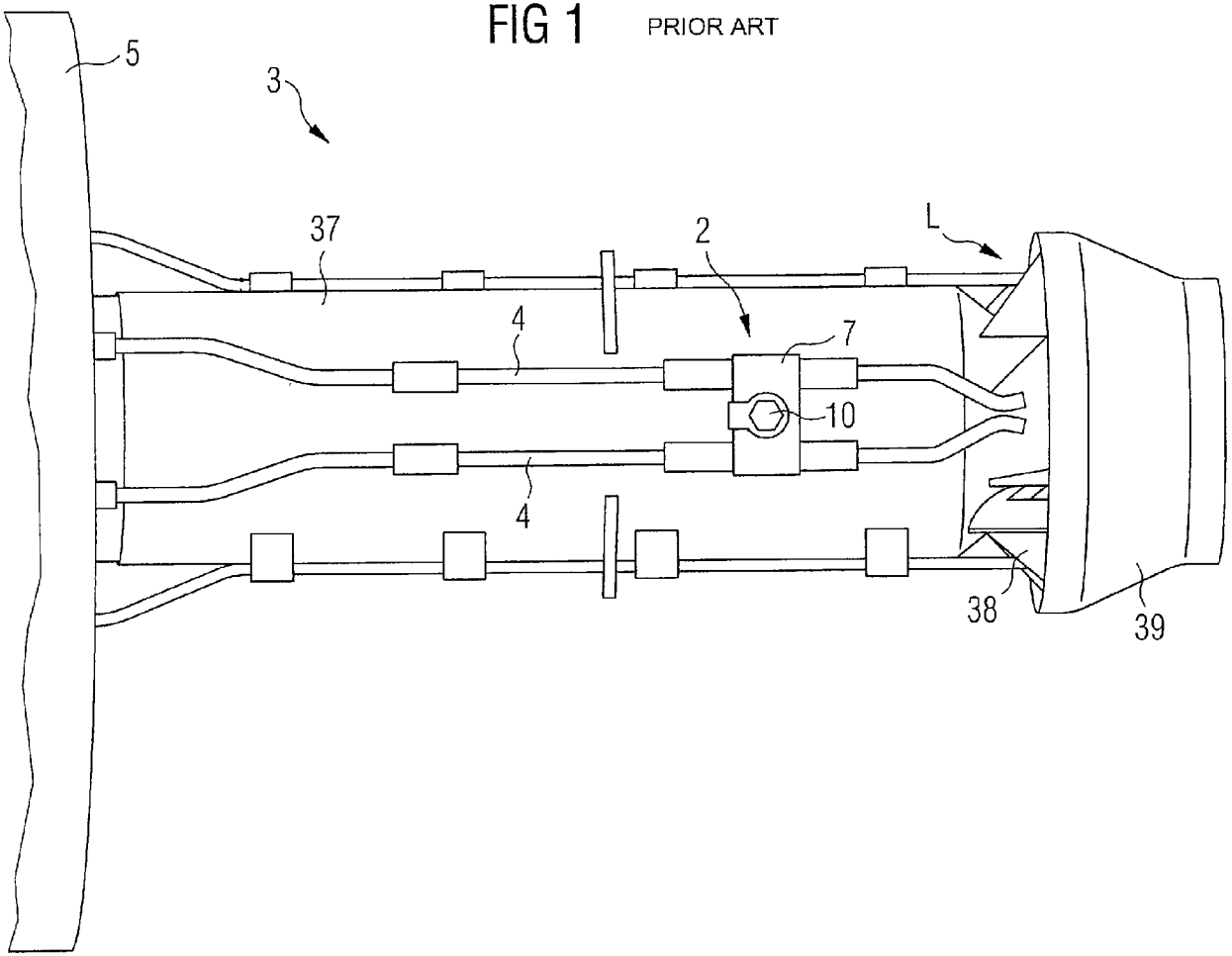
FIG 1 PRIOR ART
FIG. 1 shows a schematic diagram of a burner with ignition electrodes.

A prior art burner with two ignition electrodes and a bracket is initially described in greater detail below with reference to FIGS. 1 and 2. FIG. 1 shows a burner for a gas turbine with a flange 5, a burner carrier in the form of a pipe 37, a swirler 38 which is also called an axial mesh, and a nozzle 39 which concentrically surrounds the swirler 38. The burner also features ignition electrodes 4 and a bracket 2. The bracket 2 comprises a clamp 7 and a screw 10.

The pipe 37 adjoins a flange 5. Both elements are arranged slightly eccentrically to each other. Fastened to the outside of the pipe 37 with a bracket 2 are the ignition electrodes 4. The ignition electrodes 4 essentially run in parallel with each other.

In operation air L is supplied to the swirler 38 and swirled by the blades of the swirler 38. At the same time fuel is fed to the swirler 38 through the inside of the pipe 37. The fuel is ignited by an ignition spark that is formed between the two ignition electrodes 4. A flame is generated which is carried into the combustion chamber (not shown) and burns the air-fuel mixture. The hot gas thus produced under high pressure is supplied to the turbine.

Figure 2:
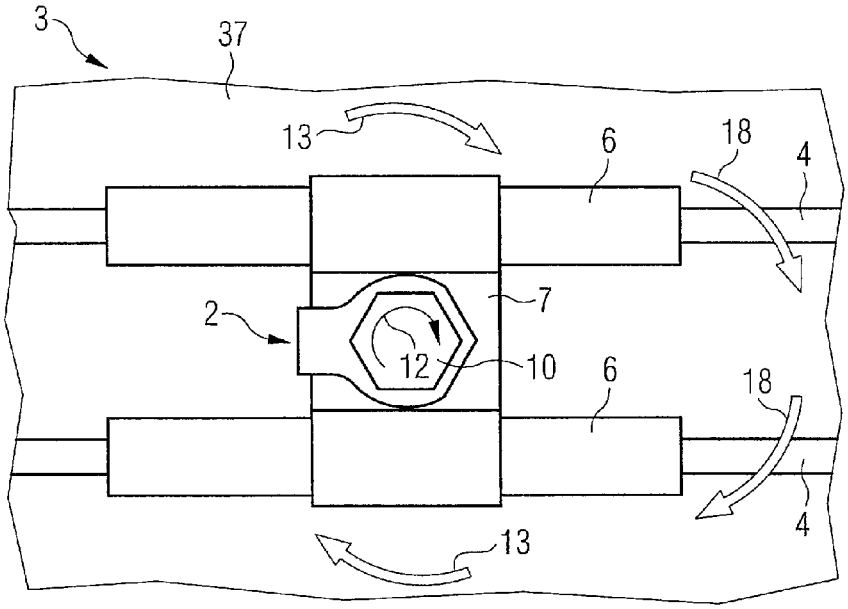
FIG 2 PRIOR ART
FIG. 2 shows a schematic diagram of a bracket in accordance with the prior art.

FIG. 2 shows the section of the burner 3 shown in FIG. 1 in which the bracket 2 is located. A part of the pipe 37, two ignition electrodes 4 and the bracket 2 that fastens the ignition electrodes 4 to the pipe 37 can be seen in FIG. 2. The ignition electrodes 4 are provided with a ceramic shroud 6 in the area in which the bracket 2 is located. Essentially they run in parallel to one another.

The bracket 2 consists of a clamp which is attached with the aid of a screw 10 to the pipe 37. The screw 10 turns in the direction indicated by an arrow 12. In this arrangement there is the danger of the clamp 7 also being twisted slightly when the screw 10 is tightened in the direction of rotation 12. The twisting of the clamp 7 is indicated by arrows 13. The twisting of the clamp 7 can lead to a bending of distortion of the ignition electrodes 4. This is indicated by arrows 18. The bending or distortion of the ignition electrodes can lead to a change in the gap between the ignition electrodes 4 and possibly also to the ignition electrodes 4 breaking. This is avoided by the inventive burner.

Figure 3:
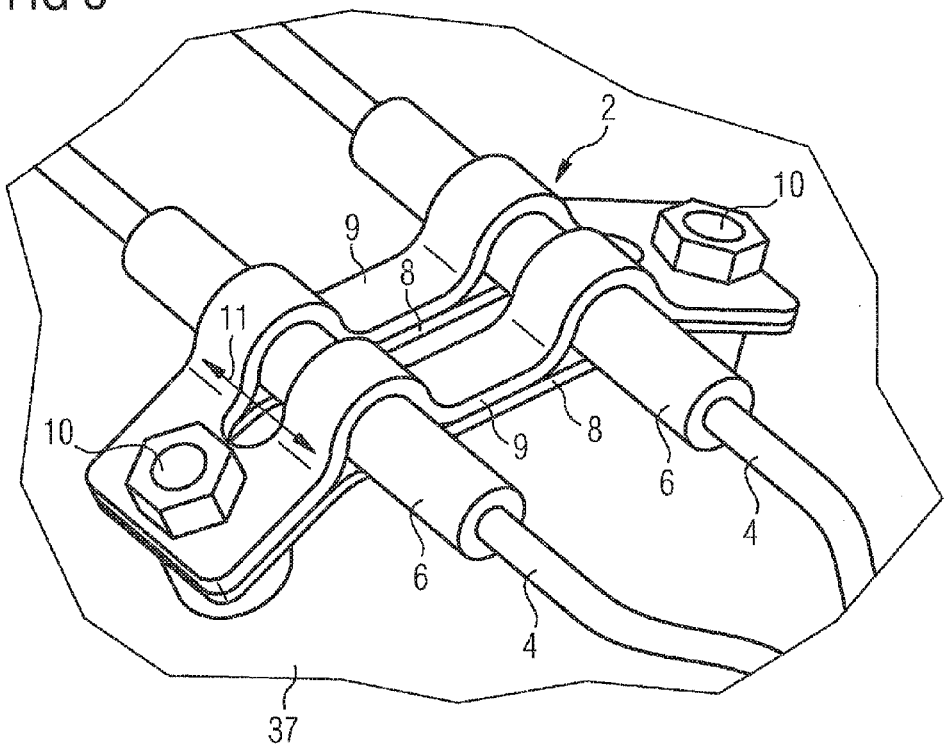
FIG. 3 shows a schematic diagram of a burner with an inventive bracket in a perspective view.

The inventive burner is described in greater detail below in a first exemplary embodiment which refers to FIGS. 3 and 4. FIG. 3 shows a perspective view of the inventive bracket. A section of the burner carrier or of the pipe 37 on which the bracket 2 is located can be seen in FIG. 3. The bracket 2 fastens two ignition electrodes 4 to the pipe 37 with the aid of two screws 10 and two clamps 8, 9. The ignition electrodes 4 are provided with a ceramic shroud 6 in the area of the bracket 2. The ignition electrodes 4 essentially run in parallel to each other.

Figure 4:
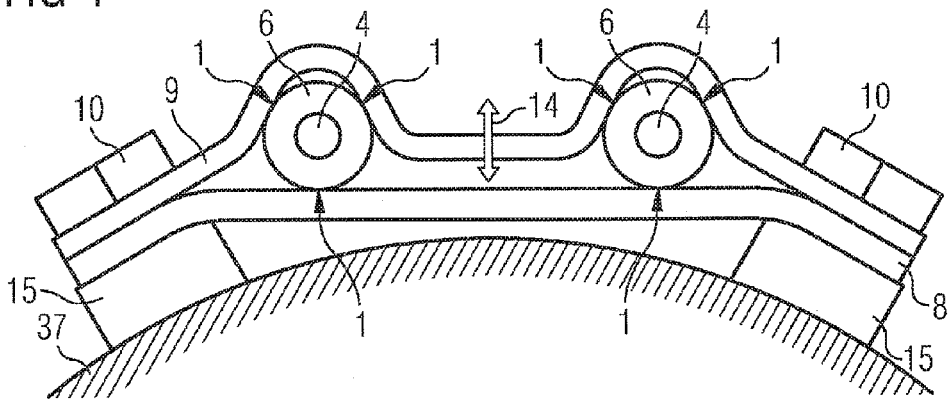
FIG. 4 shows a radial cross section through the inventive bracket.

FIG. 4 shows the inventive bracket in a sectional view along the radial direction of the pipe 37. The part of the pipe 37 in which the bracket 37 is located can be seen in FIG. 4. The two clamps can be seen which form a flat support clamp 8 and a curved fixing clamp 9 which are fastened to the pipe 37 with the aid of spacer bolts 15 and screws 10. Fixed between the support clamp 8 and the fixing clamp 9 running in parallel to one another are two ignition electrodes. The ignition electrodes 4 have a ceramic shroud 6 in the area of the bracket 2.

The support clamp 8 is located between the pipe 37 and the ignition electrodes 4 or their ceramic shroud 6 respectively. The ignition electrodes 4 each rest on one support point 1 on the flat support clamp 8. Located on the side of the ignition electrodes 4 opposite to the support clamp 8 is the fixing clamp 9 which fixes the ignition electrodes 4 at a specific distance from each other. The fixing clamp 9 has raised sections in the area of an ignition electrode in each case, but these do not have a circular cross section but an approximately sine-wave cross section. This means that the entire raised section is not in contact with the respective ignition electrode 4, but only at two points 1, as can be seen in FIG. 4. Raised section cross sections other than sine-wave cross sections, for example triangular-shape cross sections, would lead to the same result.

Although these points are referred to as support points, because of the axial extent of the fixing clamp 9 and the support clamp 8, they are actually support lines extending in an axial direction of the ignition electrodes. The ignition electrodes 4 are thus inventively supported between the support clamp 8 and the fixing clamp 9 so that they each touch the fixing clamp 9 at two points or lines of their periphery and touch the support clamp 8 at a third point or a third line of their periphery. These fixing points 1 of an ignition electrode 4 preferably lie at their periphery offset at an angle of appr. 120° to each other. Other angles of the fixing points 1 to each other are also possible, provided a static fixing of the ignition electrodes 4 is ensured.

The fixing clamp 9 is characterized in the present exemplary embodiment by having sprung-support properties overall. The spring effect is indicated by an arrow 14 that indicates the possible movement of the fixing clamp 9 in the radial direction. The ability of the ignition electrodes 4 to move in an axial direction is guaranteed by this springing. This is indicated by an arrow 11 (FIG. 3). The ability to move axially makes it possible for the thermal expansion of the ignition electrodes 4 resulting from the heat arising during the operation of the burner to be compensated for. Furthermore each ignition electrode 4 is provided with sprung support radially in the bracket by the support clamp 8 and the fixing clamp 9. This allows compensation for the radial thermal expansion of the ignition electrodes 4 resulting from the heat to be compensated for and any vibrations of the ignition electrodes 4 that might occur to be taken up. In the present exemplary embodiments only the fixing clamp 9 is embodied to provide radial sprung support.

The support clamp 8 and the fixing clamp 9 are screwed to the pipe 37 with the aid of two screws 10. The screws 10 are arranged in this case so that ignition electrodes 4 are located between them. The use of two screws 10 prevents the fixing clamp 9 and/or the support clamp 8 being distorted during the fastening of the fixing clamp 9 and the support clamp 8 to the pipe 37. Alternatively more than two screws can also be used.

A second exemplary embodiment of the bracket of the inventive burner is described in greater detail below with reference to FIGS. 5 and 6. Elements corresponding to elements in the first exemplary embodiment are provided with the same reference signs and are not described again to avoid repetition.

Figure 5:
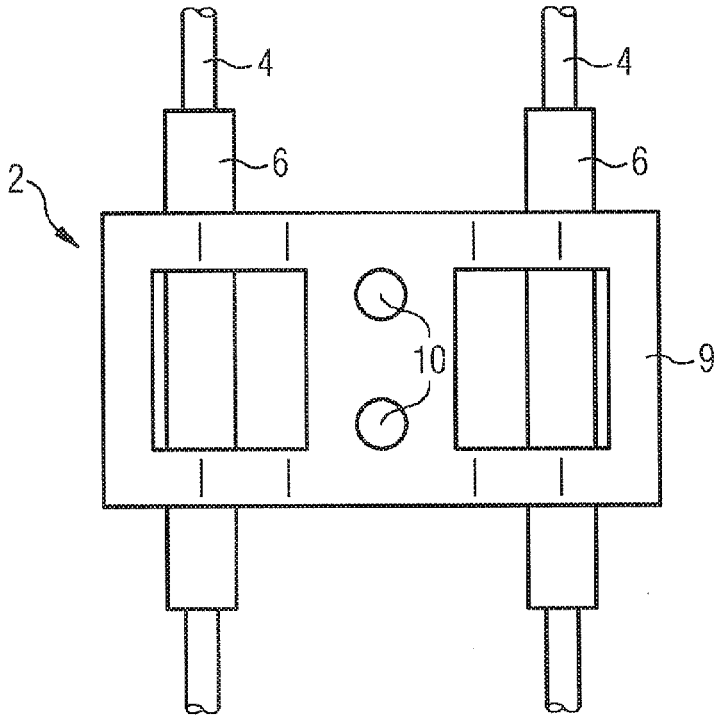
FIG. 5 shows an overhead view of an inventive bracket.

FIG. 5 shows a schematic diagram of an overhead view of the inventive bracket 2. Two ignition electrodes running in parallel to one another that are provided with a ceramic shroud 6 in the area of the bracket 2 can be seen in FIG. 5. Inter alia the bracket includes a fixing clamp and two screws 10. In this exemplary embodiment the screws 10 are arranged such that these are located between the two ignition electrodes 4. In this case too the fixing clamp 9 is prevented from distorting with the aid of the two screws 10. Basically it is also possible to use more than two screws for fixing.

Figure 6:
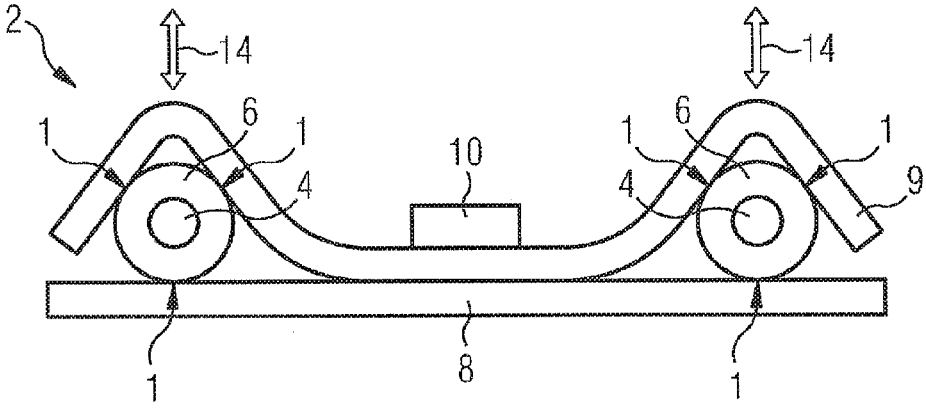
FIG. 6 shows a radial cross section through the inventive bracket depicted in FIG. 5.

FIG. 6 shows the inventive bracket 2 in a sectional view. The two ignition electrodes 4 which are surrounded by a ceramic shroud 6 and rest on the support clamp 8 can be seen in the diagram. The ignition electrodes 4 are retained in their position from above by the fixing clamp 9. The screws 10 used for fastening are located in the center between the two ignition electrodes 4.

The fixing clamp 9 is bent in the area of the ignition electrodes 4 so that it touches the ignition electrodes 4 in each case at two points 1 of the periphery of the ignition electrodes 4. The fixing clamp has sprung properties in the area of its bends. The movement of the fixing clamp possible as a result of the springing is identified for example by arrows 14. The springing of the fixing clamp enables inherent vibrations of the ignition electrodes to be taken up by the fixing clamp 9. Otherwise the bracket 2 described in this exemplary embodiment has the same advantages as described in the framework of the first exemplary embodiment.

In summary the inventive sprung three-point fixing makes a stable fastening of ignition electrodes to the outside of a burner possible that allows for axial and radial expansions and takes up vibrations.

The invention claimed is:

1. A burner, comprising:

two ignition electrodes, a portion of each of said ignition electrodes surrounded by an individual ceramic shroud; and a bracket holding each of said individual ceramic shrouds between a lower support clamp and an upper fixing clamp, said lower support clamp contacting a periphery of each of said individual ceramic shrouds at one point and said upper fixing clamp contacting the periphery of each of said individual ceramic shrouds at two further points, the bracket being fastened to an outer surface of the burner with two fastening elements.

2. The burner as claimed in claim 1, wherein the three points are distributed around the periphery of the ignition electrode so that an angle between each set of two of the three points is 120°.

3. The burner as claimed in claim 1, wherein the two ignition electrodes are supported in the bracket to allow for an axial movement.

4. The burner as claimed in claim 1, wherein each ignition electrode is supported radially sprung in the bracket.

5. The burner as claimed in claim 1, wherein the bracket comprises a clamp with radial springing.

6. The burner as claimed in claim 1, wherein the fastening elements are screws.

7. A gas turbine, comprising:

a burner, comprising:

two ignition electrodes, a portion of each of said ignition electrodes surrounded by an individual ceramic shroud; and a bracket holding each of said individual ceramic shrouds between a lower support clamp and an upper fixing clamp, said lower support clamp contacting a periphery of each of said individual ceramic shrouds at one point and said upper fixing clamp contacting the periphery of each of said individual ceramic shrouds at two further points, the bracket being fastened to an outer surface of the burner with two fastening elements.

8. The gas turbine as claimed in claim 7, wherein the three points are distributed around the periphery of the ignition electrode so that an angle between each set of two of the three points is 120°.

9. The gas turbine as claimed in claim 7, wherein the two ignition electrodes are supported in the bracket to allow for an axial movement.

10. The gas turbine as claimed in claim 7, wherein each ignition electrode is supported radially sprung in the bracket.

11. The gas turbine as claimed in claim 7, wherein the bracket comprises a clamp with radial springing.

12. The gas turbine as claimed in claim 7, wherein the fastening elements are screws.

* * * * *